US006296137B1

(12) United States Patent
Bjørnsen

(10) Patent No.: US 6,296,137 B1
(45) Date of Patent: Oct. 2, 2001

(54) BEVERAGE CAN DEVICE

(75) Inventor: Petter Konrad Bjørnsen, Stavanger (NO)

(73) Assignee: Topad AS, Heggedal (NO)

( * ) Notice: Subject to any disclaimer, the term of this patent is extended or adjusted under 35 U.S.C. 154(b) by 0 days.

(21) Appl. No.: 09/471,763

(22) Filed: Dec. 23, 1999

Related U.S. Application Data

(63) Continuation-in-part of application No. 09/068,667, filed on May 12, 1998.

(30) Foreign Application Priority Data

Nov. 24, 1995 (NO) ..... 954775
Oct. 21, 1996 (NO) ..... 964469

(51) Int. Cl.[7] ..... B65D 51/22

(52) U.S. Cl. ..... 220/258; 220/269; 220/359.2; 220/805; 220/806; 220/521

(58) Field of Search ..... 220/212, 231, 220/240, 256, 257, 258, 269, 270, 305, 359.1, 359.2, 804, 805, 806, 521, 522

(56) References Cited

U.S. PATENT DOCUMENTS

| | | | | |
|---|---|---|---|---|
| 1,879,517 | | 9/1932 | Rowbotham . | |
| 2,120,403 | | 6/1938 | Godfrey . | |
| 2,804,201 | | 8/1957 | Chappell . | |
| 3,112,824 | | 12/1963 | Lemelson . | |
| 3,438,533 | * | 4/1969 | Hanisch et al. | 220/257 |
| 3,638,787 | | 2/1972 | Phillips, Jr. . | |
| 4,177,933 | * | 12/1979 | Lumpp | 220/307 |
| 4,651,890 | | 3/1987 | Coker et al. . | |
| 4,708,257 | | 11/1987 | Deline . | |
| 4,749,100 | * | 6/1988 | Eberhart | 220/306 |
| 4,917,258 | | 4/1990 | Boyd et al. . | |
| 4,927,048 | * | 5/1990 | Howard | 220/257 X |
| 5,105,964 | * | 4/1992 | Heath | 220/254 |
| 5,119,955 | * | 6/1992 | Granofsky | 220/257 X |
| 5,131,554 | | 7/1992 | Kuo . | |
| 5,139,163 | | 8/1992 | Diaz | 220/258 |
| 5,221,020 | * | 6/1993 | Brimo, II | 220/357 |
| 5,273,176 | | 12/1993 | Diaz | 220/258 |
| 5,339,975 | | 8/1994 | Stoner | 220/4.27 |
| 5,370,262 | | 12/1994 | Kato | 220/731 |
| 5,647,497 | * | 7/1997 | Labbe | 220/257 |

FOREIGN PATENT DOCUMENTS

| | | |
|---|---|---|
| 0404734 | 12/1990 | (EP) . |
| 39104 | 6/1924 | (NO) . |
| WO 9604181 | 2/1996 | (WO) . |

* cited by examiner

*Primary Examiner*—Stephen K. Cronin
(74) *Attorney, Agent, or Firm*—Abelman, Frayne & Schwab

(57) ABSTRACT

A cover or lid device for attachment to a depressed top portion of a beverage can, said top portion being of a type having as an integral unit a wall, a can top member with pouring aperture providing means, and a recessed portion bridging said wall and said top member, said cover or lid device comprising a plate member, a circumferential ring member integral with said plate member, and a resilient member member attached to an outside face of said ring member, said resilient member having in cross section an upper lip portion, a lower bead portion and a concave portion therebetween, said lip portion for engaging said wall and said bead portion for fitting into said recessed portion. Said resilient member may be made from a soft material, such as soft plastics. An edible or non-edible article may be accomodated between said plate member and said can top member.

27 Claims, 12 Drawing Sheets

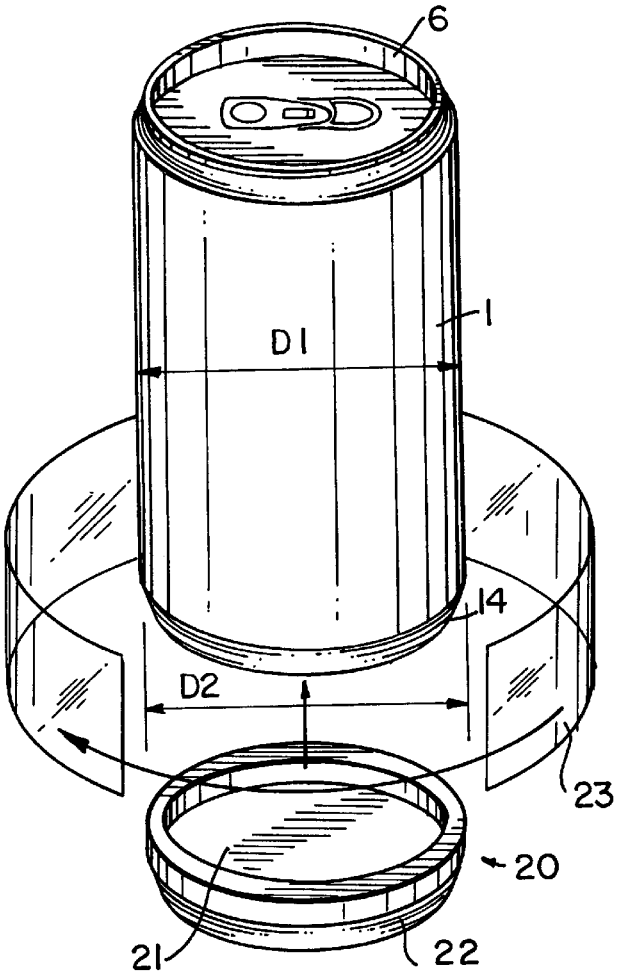
FIG. 14
FIG. 15
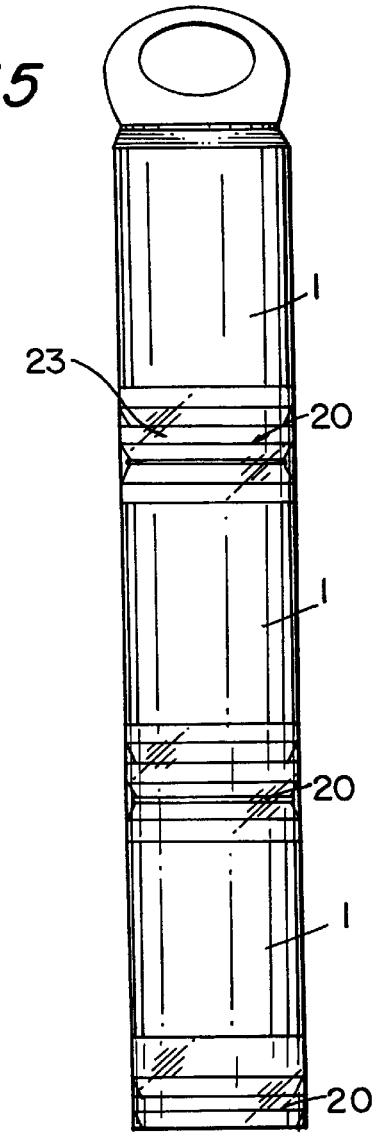

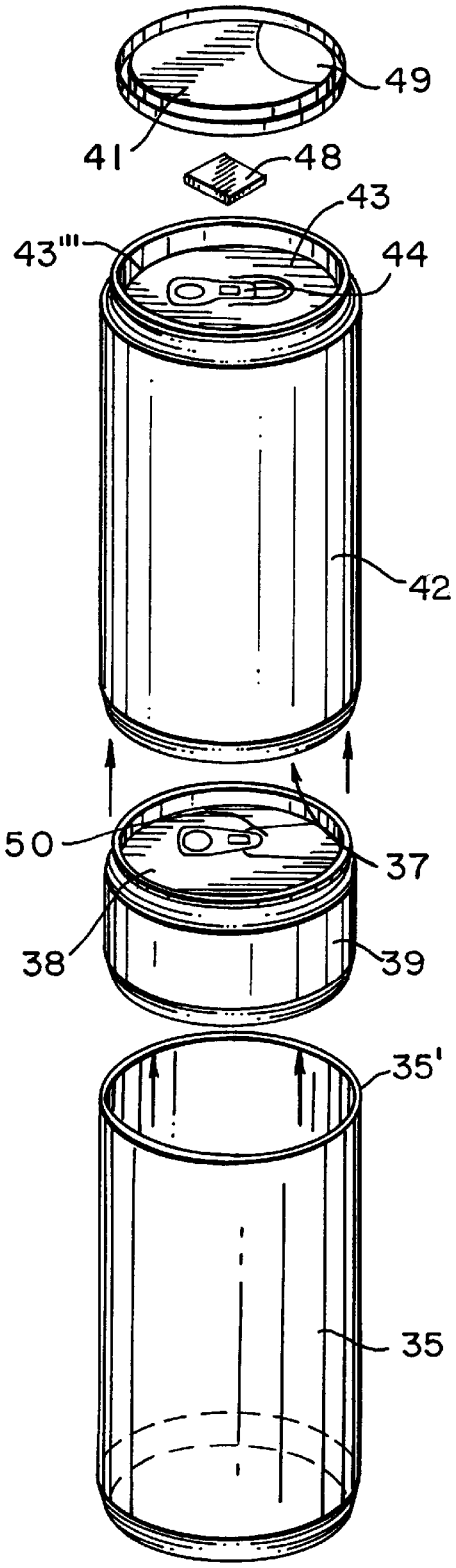
FIG. 19
FIG. 20
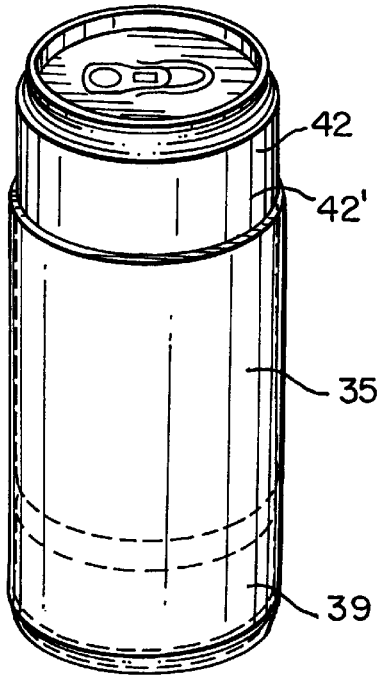
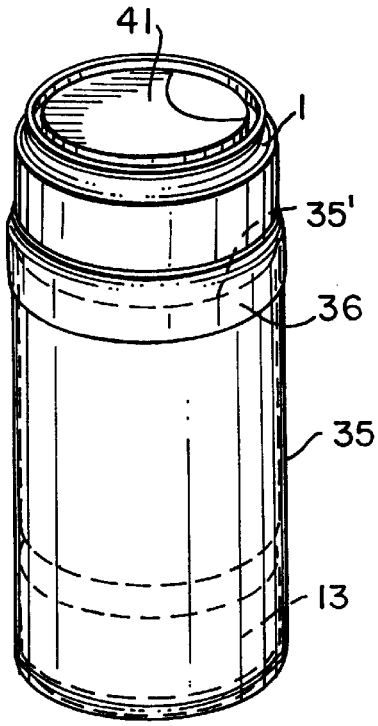
FIG. 21

BEVERAGE CAN DEVICE

This application is a continuation in part of U.S. Ser. No. 09/068,667, filed May 12, 1998, now abn.

The present invention relates to a cover or lid device for attachment to a beverage can as disclosed in the preamble of the attached patents claims 1 and 22.

The point of departure for the present invention is to provide in connection with beverage cans a best possible covering of the top and/or bottom of the can, so that there is no likelihood of primarily the depressed top part of the can becoming contaminated with dirt, dust or the like around the pouring aperture of the can, whilst ensuring that the can is capable of being stacked. More specifically, it is an object of the present invention to provide a cover or lid device which is capable of not only sealing off said depressed top part, but also to conceal an article between said depressed top part and a rear face of said device. It is however, no intention of the present invention to provide a cover or lid which extends over the top rim of the can.

U.S. Pat. No. 4,927,048 relates to a beverage can having a sanitary cover which is designed to rest over the top portion of the can and the fold around the folded edge between the cylindrical part of the can and its top. The sanitary cover must in its orientation be in alignment with the position of the pouring aperture of the can, so that when the cover is torn off, the pouring aperture and the aperture generating pull means are exposed. In an automation process this will require relatively expensive equipment in order to ensure that the mutual orientation is made possible, whilst the folding operation will cause a reduction in the production rate. A similar structure is shown in U.S. Pat. Nos. 3,438,533; 5,105,964; and 5,119,955.

From U.S. Pat No. 5,131,554 it is known to provide a beverage can with a dust cover which is riveted to the pull means which is to be used to tear open the pouring aperture. The cover is thus designed to lie completely flush with the top of the can and requires a can type which is not conventionally used.

U.S. Pat. No. 5,273,176 relates to a solution where a cover capable of being pivoted upwards can be provided over the top of the can, and where the edges of the cover extend beyond the periphery of the can top. The cover has a through-going hole for a straw and is designed to be positioned such that relative to the pouring aperture of the can, said hole in the cover corresponds to the pouring aperture when this has been opened. The object of the taught solution is also to be able to close the cover after drinking from the can with the aid of the straw.

A disadvantage of known solutions is that the stackability of the cans is affected, whilst arrangement in connection with, e.g., a six-pack, is rendered virtually impossible owing to the reduced attachment flange on the can. Furthermore, such prior art covers are vulnerable as regards accidental tearing.

U.S. Pat. No. 5,139,163 relates to a solution reminiscent of that taught in U.S. Pat. No. 5,273,176. In this known solution, clustering, e.g., a six-pack, is rendered completely impossible owing to the fact that the cover rests on the outside of the can top and the top flange of the can is no longer accessible. The cover is provided with a tear-off means to make the pouring aperture of the can and its pull means accessible. Just as in the other known solutions, a proportional, mutual orientation between the positioned cover and the pouring aperture of the can is required if the user is to enjoy the benefits the cover is intended to give. However, a solution of this kind is difficult to combine with an automated process.

U.S. Pat. No. 4,708,257 describes a beverage can with a seal which is adhered or shrunk onto the top of the can to prevent the top of the can from being contaminated. The seal may consist of a circular, thin film or foil which curls up where it is torn open from one side.

U.S. Pat. No. 4,651,890 makes known a solution wherein on the underside of the can there is provided a tear-open pouch containing a moist wipe means for cleaning the top of the beverage can prior to drinking directly from the can.

U.S. Pat. No. 1,879,517 relates to a can, jar or the like, where the top bottom of the can is provided with a further lid or cover in addition to the real lid and cover, and where this additional lid or cover may contain an article of some kind.

U.S. Pat. No. 3,638,787 relates to a special package for packing several cans together in addition to a fragile unit of some kind which is not a part of the actual cans, but is hidden by the packaging. This solution is particularly well suited in connection with packing fragile articles which cannot be packed mechanically.

U.S. Pat. No. 3,112,824 relates to a can or bottle wherein the top of the can or bottle is provided with a cover which may contain an article of some kind.

U.S. Pat. No. 4,917,258 relates to a lid which can be snapped on to a beverage can.

U.S. Pat. No. 2,804,201 relates to a solution whereby a lid can be placed on the top of a can which incorporates a can opener key, and where the lid when turned can be brought into engagement with the handle of the can opener key.

U.S. Pat. No. 2,120,403 relates to a solution where some form of advertising matter may be provided on the actual can opener key which is secured in a conventional manner to the top of the can, whereupon the top of the can may be covered with a lid. This lid is shown having various types of design where it is possible to allow the space between the lid and the cavity of the can to contain an article of some kind.

European Patent Publication 404 734 shows a further illustration of the state of the art, where the edge of a beverage can may be provided with a snap-on drinking lip so that the person drinking from the can does not come into direct contact with the metal of the beverage can, whilst the device also enables a certain covering of the exposed aperture leading into the cavity of the can, which may be practical if there is a desire to temporarily close the can.

Further, U.S. Pat. No. 5,647,497 discloses a protective, removable cover for a beverage container, said cover being a piece of sheet material covering at least a major portion of the partially stamped portion of the top wall, and is contoured to fit on the outer top wall surface inside the top annular edge surface. An annular strip of glue removably adheres the piece of sheet material to the outer top wall surface inside the top annular edge surface. A peripheral tab may be provided on the cover to facilitate manaual removal thereof from the outer top wall surface. However, use of glue in this manner is not a practical solution, nor aesthetical from a customer point of view ehen the cover is removed from the can.

An object of the present invention is to provide a solution in connection with a beverage can, whereby the cover or lip device which is to be arranged onto the recessed top surface of the can is capable of being attached in a simple manner.

The characterising features of the device according to the invention are set forth in the claims below.

However, as mentioned above, an object of the present invention is to provide solutions where a covering of the pouring aperture of the can may be combined with other advantages, whilst at the same time other possibilities have been discovered with the present invention for the use of surfaces on a beverage can of this kind.

The invention will now be described in more detail with reference to the attached drawings.

Figure 9:
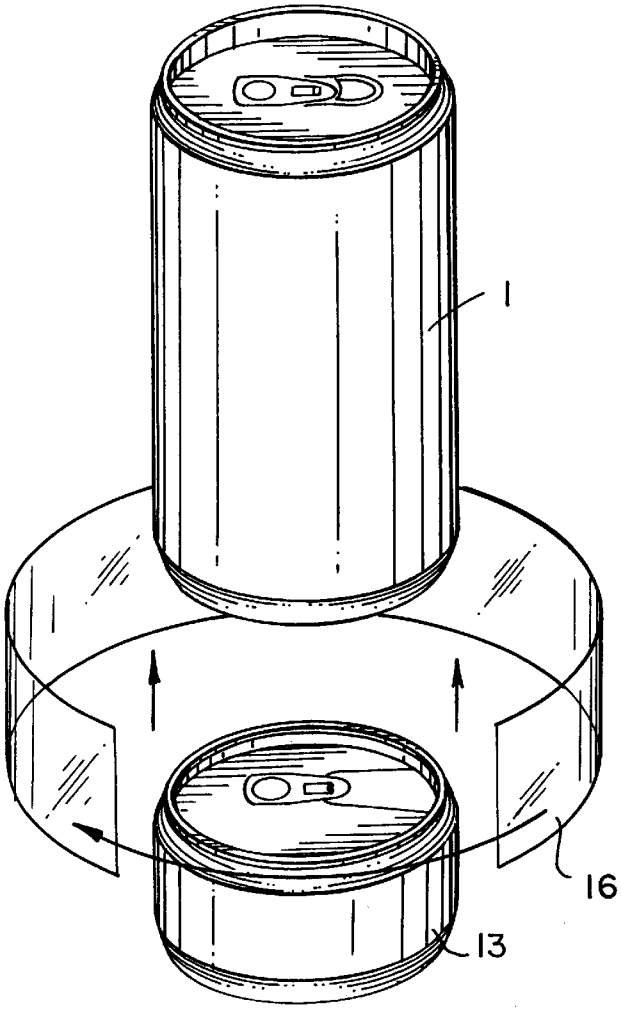
Figure 8:
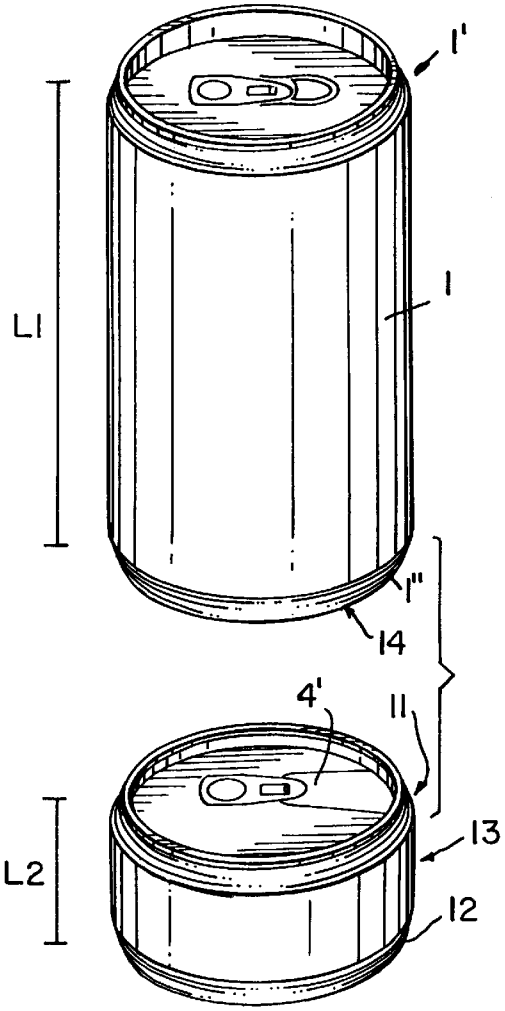

FIGS. 8 and 9 a third embodiment of the device according to the invention, with different types of joints between the cover and the beverage can.

FIGS. 10, 11, 12 and 13 show alternative methods of securing cans in clusters for the embodiment according to FIG. 8.

Figure 13:
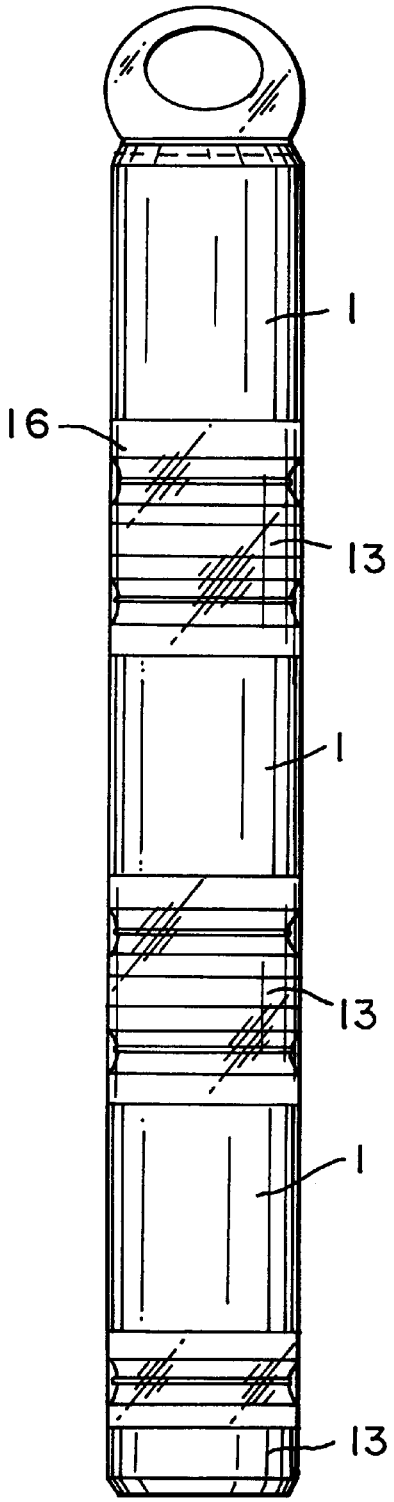

FIGS. 14 and 15 show a third embodiment of the device according to the invention and represent a modification of the solution in FIGS. 9 and 13.

Figure 17:
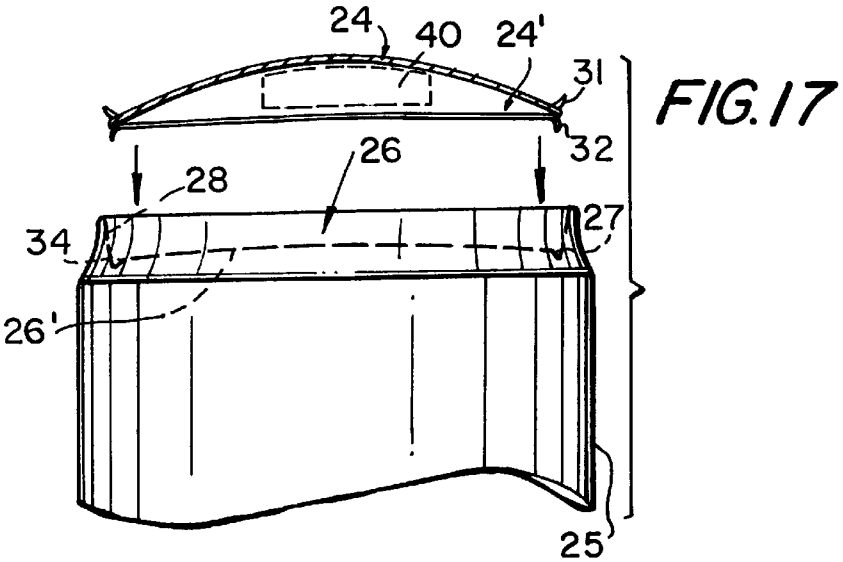
Figure 18:
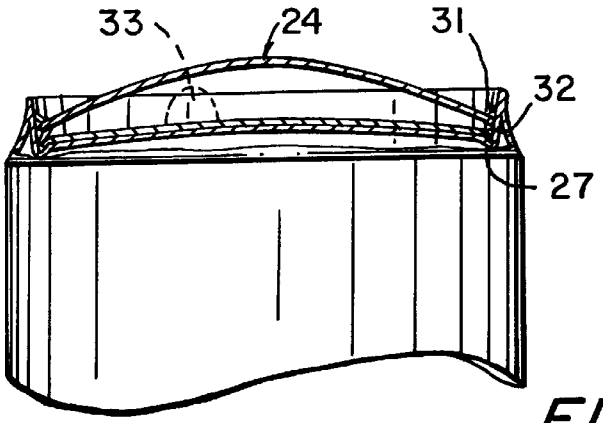
Figure 16:
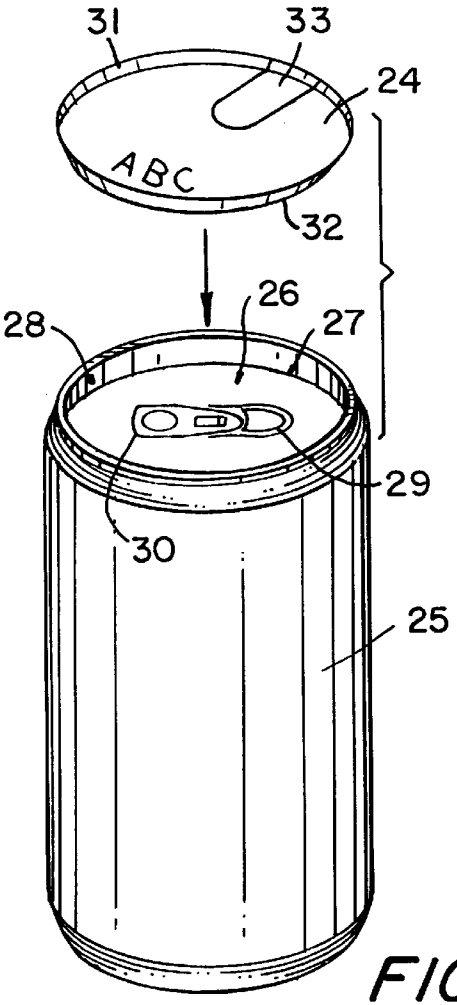
Figure 22:
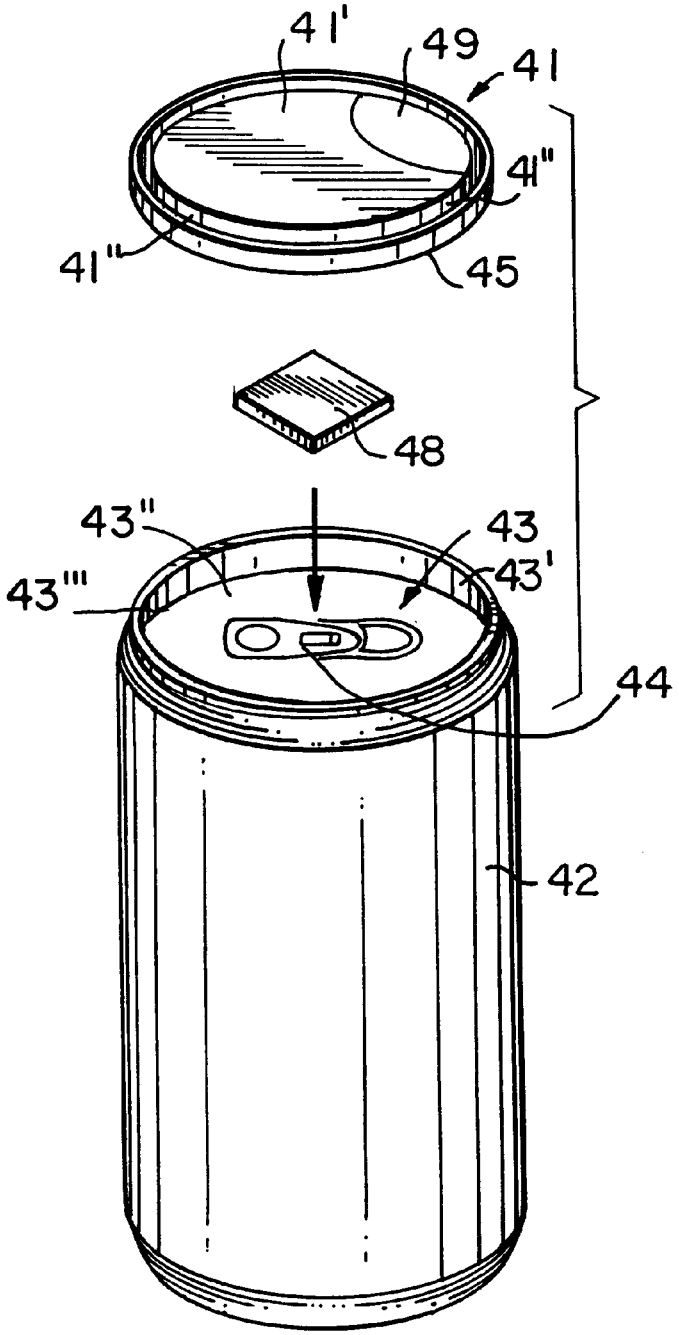
Figure 23:
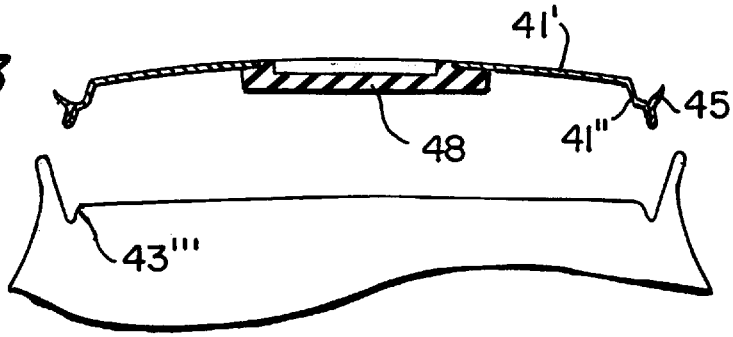
Figure 24:
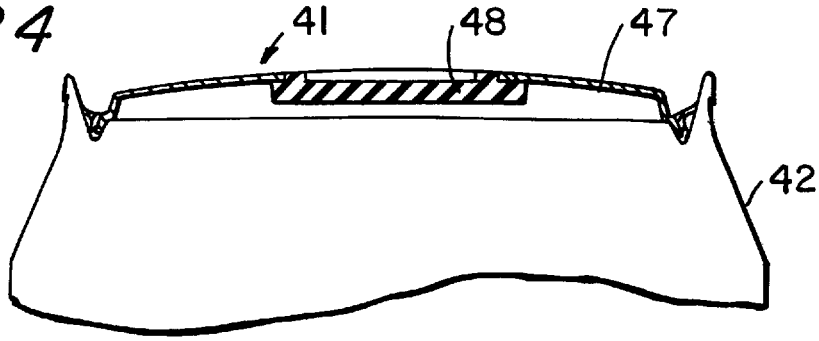

FIGS. 16 to 18 illustrate a fourth embodiment of the device according to the invention.

FIGS. 19 to 21 show a fifth embodiment of the device according to the invention.

FIGS. 22 to 25 illustrate a sixth and most preferred embodiment of the invention.

Figure 1:
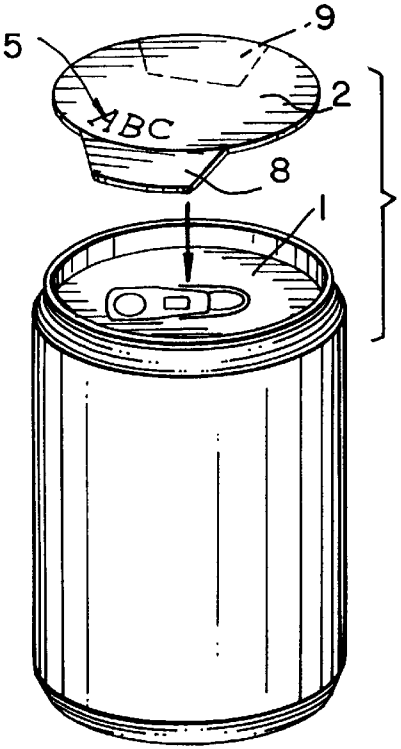
Figure 7:
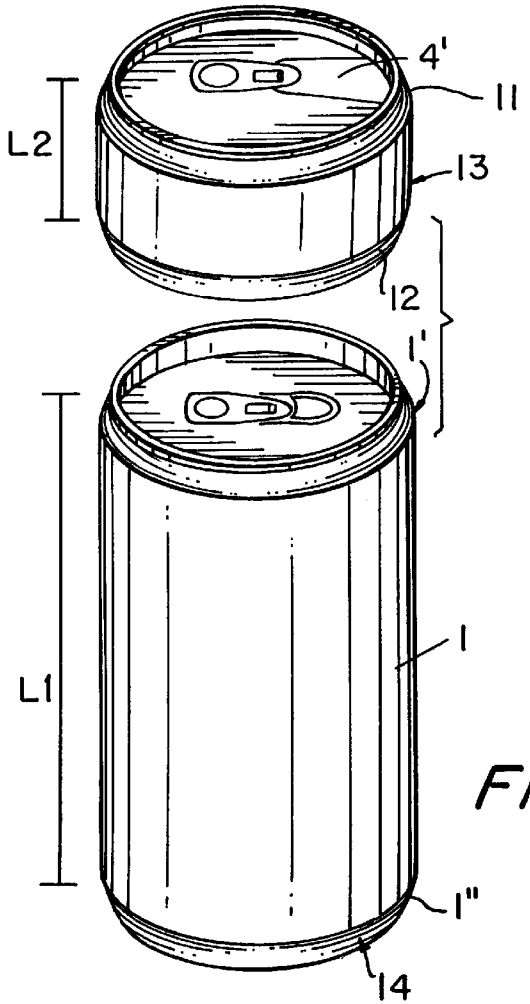
FIGS. 6 and 7 illustrate a second embodiment of the device according to the invention, with different types of joints between the cover and the beverage can.

In FIG. 1 it is shown how a beverage can 1 may be provided with a cover 2. The can 1 has a pull means 3 which actuates a weakening 4 in the top of the can in order to generate a pouring aperture.

Figure 4:
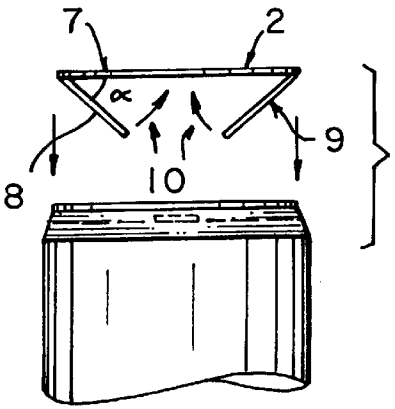
FIGS. 1 to 5 illustrates a first embodiment of the device according to the invention.
Figure 5:
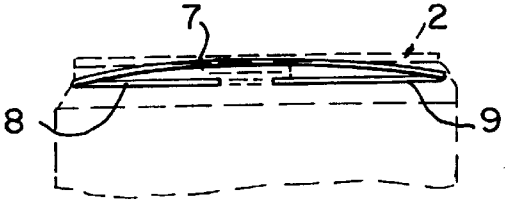
Figure 2:
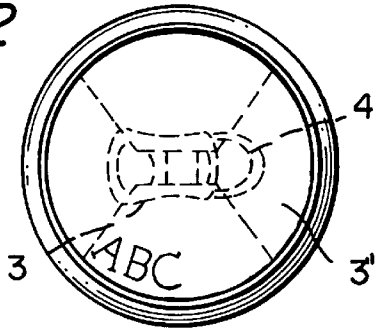
Figure 3:
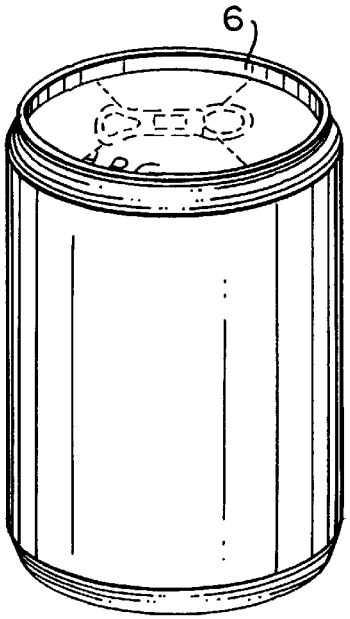

The cover 2 may, e.g., be dome-shaped, as indicated in FIG. 5. The cover 2 may be provided with print 5, e.g. a printed advertisement, indicated as a mere example in the form of the letters ABC. However, it will be understood that any form of print is possible. Alternatively the print could be in the form of impressions in the material of the cover, e.g., produced during the forming process of the cover. The cover could be wholly or partly transparent, but it is also conceivable that cover is opaque in that a coating is applied, e.g., in the form of a protecting lacquer. Furthermore, it is also possible to allow the cover 2 to be light-reflecting perhaps in order to draw better attention to the message provided on the cover. As can be seen from FIG. 1, the cover 2 is designed to fit into the depressed portion of the container top, so that the wall 6 of the depressed portion substantially bears against the periphery of the cover, as can better be understood with reference to FIG. 5.

The cover 2 will effectively protect the pouring aperture of the can from dust and contaminants before the can is emptied.

The attachment system of the cover which is shown in FIGS. 1 to 5 is particularly useful for those cases where the cover is only to be provided with print, e.g., a printed advertisement or is made having print in the form of impressions in the material of the cover. In this case the cover is preferably opaque. As can be seen from FIG. 4 the cover is made in this case of a sheet part 7 which has two diagonally arranged, backwardly slanting, opposing fixing flaps 8 and 9. These fixing flaps are designed such that when the cover 2 is pressed down towards the can top 3', the flaps 8 and 9 are bent in the direction of the front face of the cover 2 or the sheet part 7 as indicated by means of the arrows 10, whereby the fixing flaps come into engagement between the top surface 3' of the can and the said pull means 3 in connection with the pouring aperture 4. The flaps preferably have an angle of departure in the range of 40–50°, although this range must not be seen to be limiting for the present invention. As shown in FIG. 5, when the cover 2 is in place, the top part 7 thereof be will slightly curved forwards or upwards, whilst the flaps 8 and 9 remain substantially parallel to the surface 3' of the can top. In this way an effective attachment method of the cover on to the top of a beverage can is obtained. An advantage of the solution shown in FIGS. 1 to 5 is that engagement will take place with the pull means 3 irrespective of the mutual orientation of the fixing flaps 21 and 22 relative to the orientation of the pull means 3. This attachment method which can thus be seen from FIGS. 1 to 5 is particularly suitable for automated application of the cover 2. The cover 2 will effectively be under tension when it is arranged in the position shown in FIG. 5.

Figure 6:
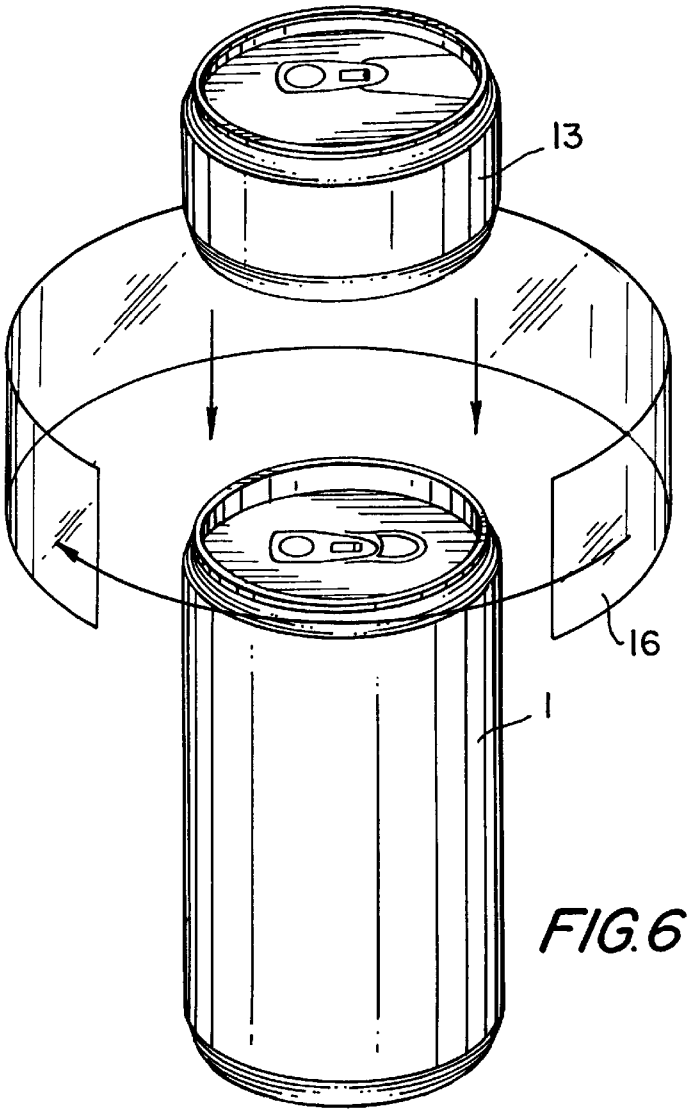

A further development of the invention is also shown in FIGS. 6 to 9 where the cover is designed as a cavity, the cover in reality being made having an upper portion 11 and a lower portion 12 which in essence correspond to the design of the upper portion 1' and the lower portion 1" of the beverage can 1. However, it can readily be envisaged that the depressed portions in the upper 11 and lower 12 portions of the cover respectively may be of a depth that is less than that of the depressed portions in the upper 1' and lower 1" portions of the can. The cover in the present case is indicated by means of the reference numeral 13. The cover has a tear-off portion 4'. The cover, which in terms of appearance resembles a beverage can, has however substantially smaller axial extent L2 than the axial extent L1 of the beverage can. As a, for the invention non-limiting, example, the cover 13 may be in the shape of a mini-can and have an axial length which is equal to about 20 to 50% of the axial extent of the beverage can 1. The cover 13 in the form of a mini-can may be secured to the beverage can, e.g., by adhesion, as shown in FIGS. 6 and 8. In the embodiment in FIG. 6, this takes place in that the lower, bevelled portion 12 of the cover 13 is provided with an adhesive, whilst in the embodiment in FIG. 8 the lower bevelled portion 14 on the beverage can is provided with an adhesive. In the embodiments according to FIGS. 7 and 9, the cover part 13 is attached to the beverage can by means of tape or shrink wrap plastics 16.

Figure 10:
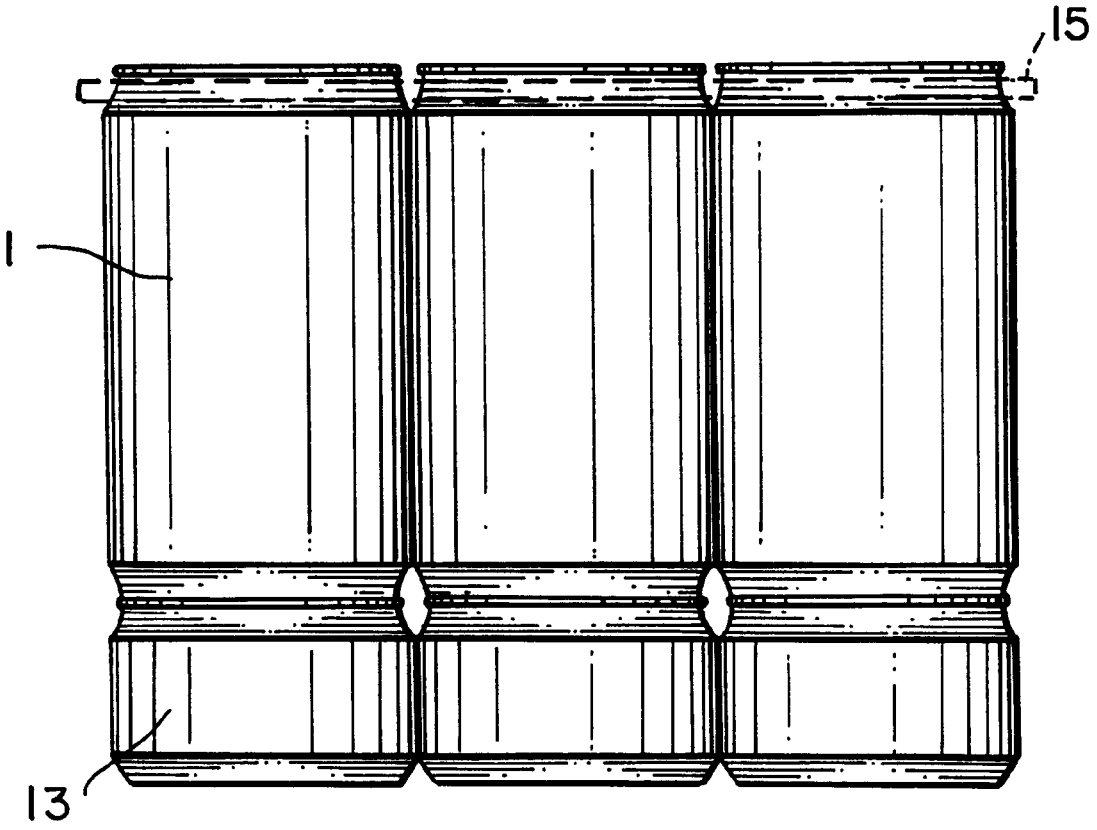

As can be seen in FIG. 10, an assembled unit consisting of a can 1 and a bottom cover 13 could form a part of a multi-pack, e.g., a six-pack. The six assembled can units consisting of three cans 1 and three bottom covers 13 are retained in a known way per se by a plastic film 15 known per se that is provided with holes and where the edges of the holes form secure engagement with the lower edge of the folded flange of the can.

Figure 11:
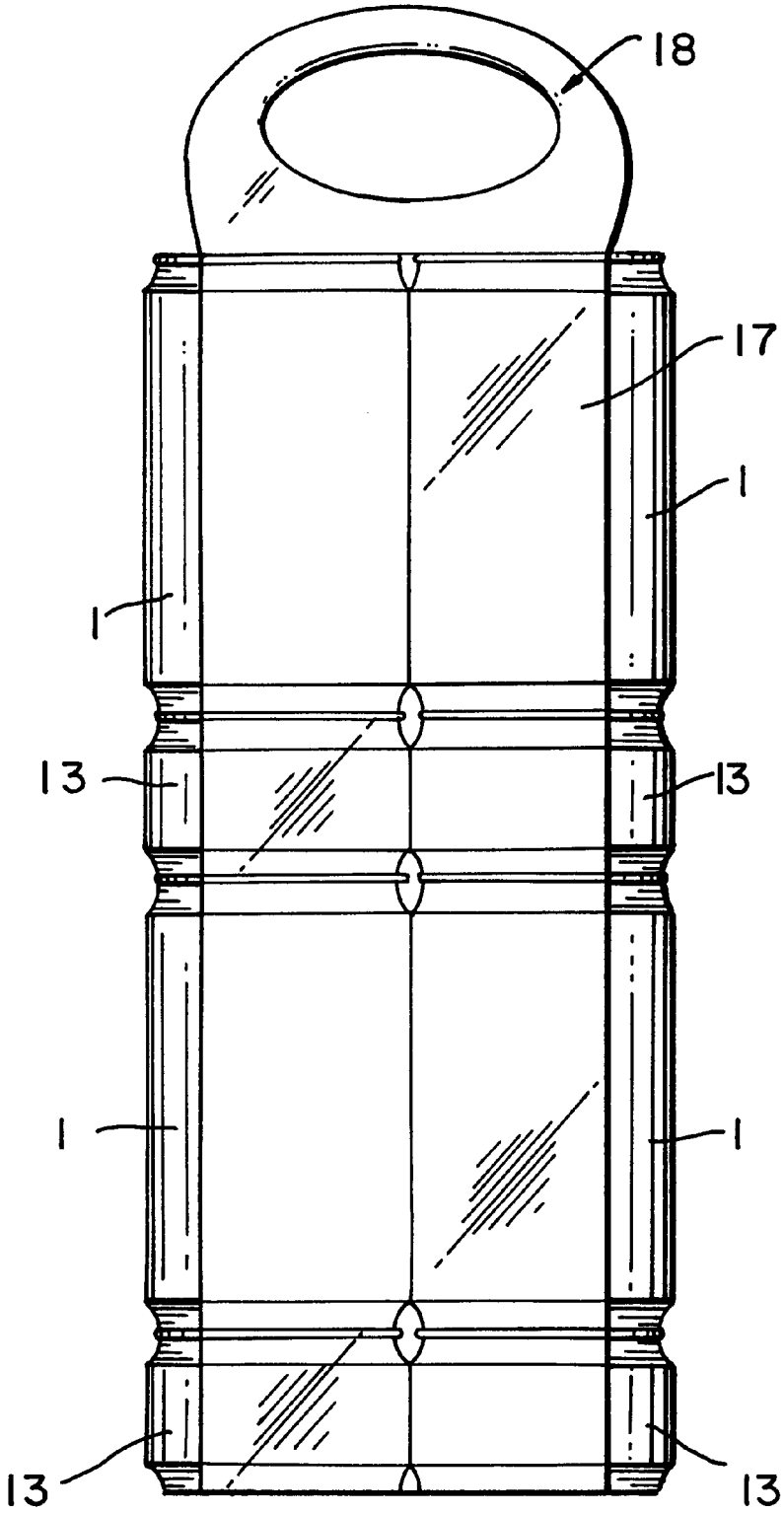

In FIG. 11 an alternative packing form is shown, e.g., of four units 1, 13, wherein a packing plastic film 17 extends around the top of the uppermost unit and around the bottom of the lowermost unit. The plastic film may optionally be of a type such that it has a carrying handle 18. It would optionally be expedient to connect the respective parts 1 and 13 in each unit with an adhesive to facilitate the packing. However, this is not a definite condition for the understanding and performance of the present invention.

Figure 12:
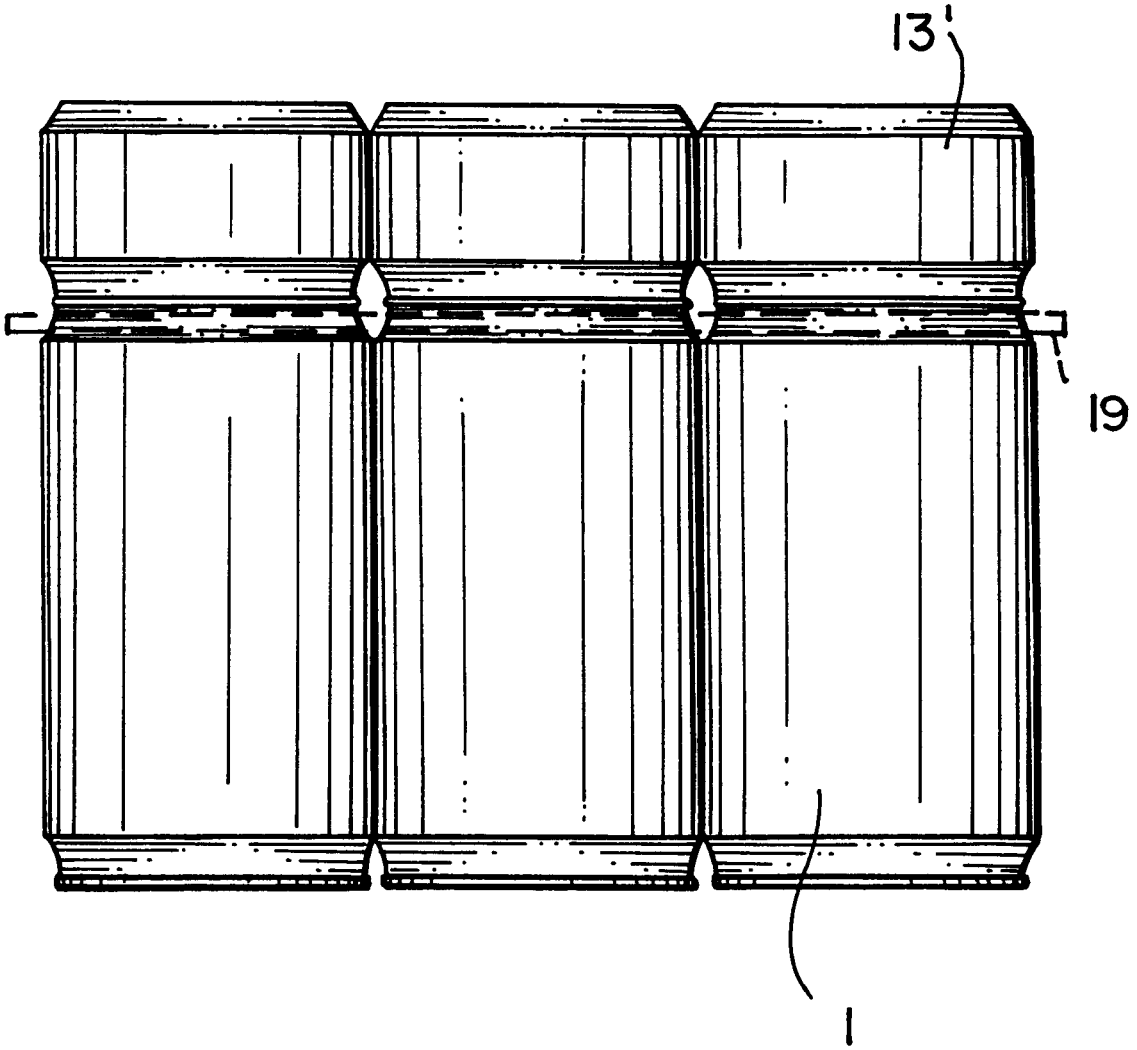

In FIG. 12 it is shown that the container or mini-can 13 may instead form a top cover or mini-can 13' for the can 1. In this case it would be expedient to join the [cover] mini-can 13' and the can 1 with an adhesive, optionally to pack the units together in the same way as shown in connection with FIG. 11. In case the cover 13' is designed to be identical to the cover or mini-can 13 which is shown in connection with FIGS. 6 to 9, and where the mini-can 13' is adhered to the beverage can 1, a six-pack, for example, may be held together by means of a supporting plastic film 19 in a manner corresponding to that shown and described in connection with FIG. 10. However, it will be understood that other packing methods will be conceivable within the scope of the invention.

In this connection reference can also be made to FIG. 13 where three units which each consist of a can 1 and a cover or mini-can 13 are arranged in a column, and where the joining takes place with the aid of tape or shrink wrap plastic 16 in the transition portions between the units.

As an example of the content in a cover or mini-can 13 or 13', mention can be made of articles in solid or liquid form, including typical taste samples such as introductory samples of new products, peanuts, chocolate and other foodstuffs or stimulants. It will immediately be appreciated that the covers represented by the mini-cans 13 and 13' will be capable of having print applied, e.g., a printed advertisement both around the periphery and on the top and bottom surfaces.

In FIG. 14 a solution is shown with a cover 20 which has a recess 21 which is adapted to the external periphery or bevelled portion 14 of the can 1, and on its other side has an axially projecting integrated body 22 with a periphery adapted to the inner wall 6 in the depressed portion on an adjacent beverage can 1. However, it is worth noting that the cover 20 has a cross-section D2 which is no greater that the cross-section D1 of the beverage can. The cover 20 in the illustrated embodiment is intended to constitute a supporting mat for the can, e.g., made of a cork material or other material which does not scratch the underlying surface on which the beverage can 1 is to be placed.

Between the depressed portion 21 and the recess in the bottom of the can there may be placed an article, e.g., selected from a group consisting of lapel badges, mini-art, mini-CDs, lottery tickets, printed matter, mini-toys, souvenirs, bonus coupons, samples, serviettes, wipes, taste samples, advertisements, change. The use of the said space or cavity for change may be particularly relevant in connection with the sale of beverage cans or bottles in vending machines.

As an alternative to cork material, the cover 20 may be made of, for example, a soft plastic material or another material which under normal conditions does not cause scratching. Optionally, the cover 20 may conceivably be made of a wood fibre material.

To be able to sell the solution shown in FIG. 14 in an expedient manner, tape or shrink plastic 23 could conceivably be used to attach the cover 20 to the beverage can 1. However, this does not rule out the use of dots of adhesive between the can 1 and the cover 20. The sales unit as shown in FIG. 15 consists of a total of three can/cover units 1, 20. The transitions between these units are made with the aid of tape or shrink wrap plastics. Alternatively, the connection can be made as shown and explained in connection with FIG. 11.

Although the said covers are preferably made of the same material as the beverage can, e.g., aluminium, this does not, of course, prevent other materials from being chosen for use in the covers. Possible alternative materials may conceivable be rigid or soft thermoplastics, or wood fibre materials, materials containing corn starch or other starch products, and optionally appropriate shrink wrap plastic materials. However, it should be noted that the choice of material for the covers should in no way be seen as limiting for the idea and scope of the invention.

In the solution shown in FIG. 11, it will be ensured that the drinking edge is kept clean by using shrink plastic between the can 1 and the cover or mini-can 13' for each unit thereof. If the mini-can 13' in addition has an upper portion which is equipped with a folded flange, it is possible to move the connecting film up to this portion of the can 13'.

In the embodiment according to FIGS. 16 to 18, the cover 24 is intended for a beverage can 25, preferably of the stackable type, wherein the top of the can has a depressed portion 26 with a further recessed rim along the inner wall 28 of the depressed portion. As previously described, the can is in a known way designed to have a detachable section connected to a pouring aperture generating pull means 30.

The cover is designed to fit into the depressed portion 26 and has a cavity 24' or a recess in its back. The wall 28 of the depressed portion surrounds and substantially bears against the periphery of the cover over at least a part of its axial extent.

This alternative solution is characterised in that the cover 24 along upper outer rim thereof has a sealing lip 31 designed to bear against said inner wall 28 and along its lower outer rim has a bead 32 designed to fit into said recessed rim 27. When the cover 24 is pressed down into the depressed portion 26 of the can and the rim 27, in the same operation there is also produced a vacuum between the back of the cover 24 and the top surface 26' of the can through vacuum actuation during the pressing action. The bead 32 is to advantage made of a material which, when the cover 24 is pressed down into the depressed portion 26 and vacuum is actuated simultaneously, is subjected to a lateral expansion into the recessed rim 27, thereby obtaining improved adhesion and sealing, so that said vacuum between the cover 24 and the depressed portion 26, 37 of the can is maintained. Furthermore, the recessed rim 27 can be provided with an adhesive 34 in order to further secure said vacuum through increased adhesion between the rim 27 and the bead 32 of the cover.

The cover is provided with a tear-off flap 33, which causes said vacuum between the cover 24 and the depressed portion 26, 27 of the can to be eliminated when the flap is torn off, whereby the bead 32 is released from the recessed rim 27, allowing the cover 24 and its optional content, such as an article 40 to be removed.

FIGS. 22 to 25 disclose an embodiment which has the advantage over the embodiment according to FIGS. 16–18 that attachment of a cover or lid 41 to a can 42 can be made by way of vacuum, without the necessity of using glue.

The can 42 has a depressed top portion 43 having as an integral unit a wall 43', a can top member 43" with pouring aperture providing means 44, and a recessed portion 43'" bridging said wall and said top member. The cover or lid device comprises a plate member 41', a circumferential ring member 41" integral with said plate member, and a resilient member 45 attached to an outside face of said ring member. The resilient member 45 has in cross section an upper lip portion 45', a lower bead portion 45" and a concave portion 45'" therebetween. The lip portion 45' engages said wall and said bead portion 45" for fitting into said recessed portion 43'". The concave portion 45'" preferably has in cross section a first radius of curvature when said device is uninstalled on the can and a second radius of curvature when installed on the can, said first radius of curvature being smaller or slightly smaller than said second radius of curvature. As seen from FIG. 25 in particular, said concave portion 45'" and said wall 41" together form a cavity 46 having an internal pressure which is less or slightly less than a pressure outside said cavity. Further, as clearly seen from FIGS. 23 and 24, the plate member 41' curves slightly in a direction away from said ring member 41". In this manner, said plate member 41' and said can top member 43" together form a sealed-off cavity space 47 for accomodation of an article 48, e.g. of edible or non-edible type. The cavity space 47 has an internal pressure preferably being less or slightly less than the air pressure external of said plate member.

Suitably, the plate member, the ring member and the resilient member are made as an integral unit, e.g. of a starch material such as a corn starch material. Alternatively and presently preferred, the plate member and the ring member are integrally made from a first material, and the resilient member is made from a second material which makes a good mechanical link with the first material. The first material is electable from the group of: metal, a first type of plastics, and cardboard, and the second material is electable from the group of: rubber, silicone rubber, a second type of plastics and starch.

Figure 25:
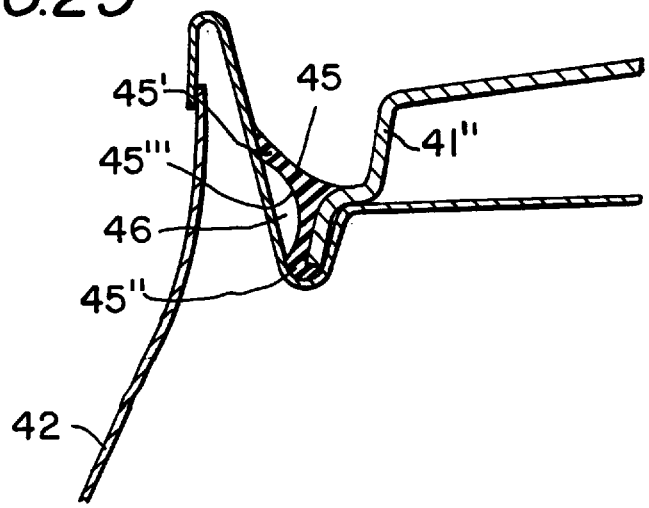

As clearly shown on FIG. 25, the ring member 41" has preferably in cross section a stepped configuration and depends from the periphery of said plate member.

The plate member 41 has a pull-to-open tab 49 in order to gain access to the cavity space 47 and the article 48.

The bead portion 45", when the cover 41 with its plate member 41' and ring member 41" is pressed down into the depressed portion 43, is preferably, but necessarily caused to expand slightly laterally into the recessed portion 43'". In order to provide an extra adhesion of the cover onto the can, the recessed portion 43'" can be provided with an adhesive for adhesion to said bead. This may be of advantage if the ambient air pressure is varying, e.g. in the air onboard an aircraft. However, adhesion of the cover 41 to the can by vacuum only (both in the cavity 46 and the cavity space 47) is preferred.

As shown on FIGS. 19–21 the can can be surrounded at least partly by an upwardly open container 35. The container 35 may serve as a drinking glass. About an upper portion 35' of the container 35 there is provided a detachable sealing means 36 elected from the group of: a band of heat shrinkable material, a sealing sleeve and a sealing tape. The sealing means 36 also sealingly contacts a peripheral portion 42' of the beverage can 42.

Between a bottom of the container 35 and a bottom of the beverage can 42 there is arranged a mini-can 39 of axial extent substantially less than the beverage can 42. The mini-can 39 has a depressed top portion 38 in order to properly engage with a bottom region 37 of the can 42. The mini-can 49 can contain edible or drinkable matter, or simply a surprise article, and said matter or article is accessible in view of the depressed top portion 38 of the mini-can having a pull-to-open tab 50.

The container 35 surrounding the assembly of the can 42 and mini-can is preferably made in the form of a drinking glass of plastic or glass. The drinking glass 35 may be made of a transparent, translucent or opaque material. Like the can 42, the outer surface of the glass may optionally be provided with decoration, ornament, information or advertising material.

However, it is important that when storing the can 1, the mini-can 39, and the drinking glass 35 that dust and dirt do not enter the container in the space between the can/mini-can assembly and the inner wall of the container 35. Therefore, around a upper portion 35' of the container 35 there is provided a sealing means 36 which is detachable, e.g., by tearing off. The sealing means may, e.g., be a band of heat shrinkable material, a sealing sleeve, a sealing tape, e.g., an adhesive tape. The sealing means 36 rests in sealing contact with a peripheral portion 42' of the can/mini-can assembly, e.g., a portion 42 of the can as indicated in FIG. 20.

Although it is not shown in FIGS. 19–21, it will be understood that a type of cover or mini-can as shown and described in connection with FIGS. 1 to 15 or FIGS. 16 to 18 could be provided in the recessed portion 43 of the can 42 or in the recessed portion 38 of the mini-can 39 depending upon whether it is the can 1; 42 or the cover 13; 39 which is uppermost in the assembly.

The solution shown in FIG. 19 is particularly advantageous in the cases where in a practical manner it is desirable to sell or distribute as a unit a can 42 containing a beverage, mini-can containing another beverage or a foodstuff in solid form, e.g., peanuts, and a drinking glass 35.

What is claimed is:

1. A cover or lid device for attachment to a depressed top portion of a beverage can, said top portion being of a type having as an integral unit a wall, a can top member with pouring aperture providing means, and a recessed portion bridging said wall and said top member, said cover or lid device comprising:

a plate member, a circumferential ring member integral with said plate member, and a resilient member member attached to an outside face of said ring member, said resilient member having in cross section an upper lip portion, a lower bead portion and a concave portion therebetween, said lip portion for engaging said wall and said bead portion for fitting into said recessed portion.

2. The device according to claim 1, wherein said concave portion has in cross section a first radius of curvature when said device is uninstalled on the can and a second radius of curvature when installed on the can, said first radius of curvature being smaller or slightly smaller than said second radius of curvature.

3. The device according to claim 1, wherein said concave portion and said wall together form a cavity having an internal pressure which is less than a pressure outside said cavity.

4. The device according to claim 1, wherein said plate member curves slightly in a direction away from said ring member.

5. The device according to claim 1, wherein said plate member, said ring member and said resilient member are made as an integral unit of a starch material.

6. The device according to claim 1, wherein said ring member has in cross section a stepped configuration.

7. The device according to claim 1, wherein said ring member depends from the periphery of said plate member.

8. The device according to claim 1, wherein said plate member has a pull-to-open tab.

9. A device according to claim 1, wherein the bead portion, when the plate member is pressed down into the depressed portion, is caused to expand laterally into the recessed portion.

10. A device according to claim 1, wherein the recessed portion is provided with an adhesive for adhesion to said bead.

11. The device according to claim 1, wherein said plate member and said ring member are integrally made from a first material, and wherein said resilient member is made from a second material.

12. The device according to claim 11, wherein said first material is elected from the group of: metal, a first type of plastics, and cardboard, and wherein said second material is elected from the group of: rubber, silicone rubber, a second type of plastics and starch.

13. The device according to claim 1, wherein said plate member and said can top member together form a sealed-off cavity space for accomodation of an article.

14. The device according to claim 13, wherein said sealed-off cavity space has an internal pressure being less than the air pressure external of said plate member.

15. A device according to claim 13, wherein said sealed-off cavity space accomodates an article.

16. A device according to claim 15, wherein said article is edible.

17. A device according to claim 15, wherein said article is non-edible.

18. A lid or cover device for attachment onto a beverage can, said can of a type having a depressed top portion with an inner wall, a recessed portion along an inner wall bottom region of the depressed portion, and a can top member with pouring aperture providing means, said recessed portion bridging said wall and said top member, said device comprising:

a plate member with a circumferential rim region integral with said plate member, said rim region having in cross section an upper sealing lip portion and a lower bead portion, said lip portion for contacting said wall and said bead portion for fitting into said recessed portion, a vacuum being provided between the can top member and the plate member upon fitting and pressing the plate member down into said depressed top portion of the can.

19. A device according to claim 18, wherein the recessed portion is provided with an adhesive for adhesion to said bead.

20. The device according to claim 18, wherein said plate member has a pull-to-open tab.

21. A device according to claim 18, wherein the bead is made of a material which, when the plate member is pressed down into the depressed portion and vacuum is created simultaneously, is caused to expand laterally into the recessed portion.

22. The device according to claim 21, wherein said plate member has a pull-to-open tab.

23. A device according to claim 18, wherein said plate member and said can top member together define a cavity adapted to accomodate an article.

24. A device according to claim 23, wherein said article is edible.

25. A device according to claim 23, wherein said article is non-edible.

26. The device according to claim 23, wherein said cavity has an internal pressure being less than the air pressure external of said plate member.

27. The device according to claim 23, wherein said plate member has a pull-to-open tab.

* * * * *